United States Patent [19]

Kubes et al.

[11] 4,248,663

[45] Feb. 3, 1981

[54] PULPING WITH AN ALKALINE LIQUOR CONTAINING A CYCLIC KETO COMPOUND AND AN AMINO COMPOUND

[75] Inventors: George J. Kubes, Dollard-des-Ormeaux; James M. MacLeod, Beaconsfield; Bruce I. Fleming, Pierrefonds; Henry I. Bolker, Pointe Claire, all of Canada

[73] Assignee: Pulp and Paper Research Institute of Canada, Pointe Claire, Canada

[21] Appl. No.: 922,020

[22] Filed: Jul. 5, 1978

[51] Int. Cl.[3] ..... D21C 3/02

[52] U.S. Cl. ..... 162/72; 162/90

[58] Field of Search ..... 162/70, 72, 90

[56] References Cited

U.S. PATENT DOCUMENTS 4,178,861 12/1979 Vanderhoek et al. ..... 162/90

FOREIGN PATENT DOCUMENTS 51-43403 4/1976 Japan ..... 162/72

OTHER PUBLICATIONS

ABIPC, vol. 46, No. 6, 12/75, Abstract #5767.

Bach et al., *Zellstofund Papier,* (i) 3 (1972), p. 1-7.

*Primary Examiner*—William F. Smith

*Attorney, Agent, or Firm*—Millen & White

[57] ABSTRACT

Lignocellulosic materials such as wood, bagasse, straw, reeds, and other plants and crops can be delignified effectively by a soda-type pulping with an alkaline liquor containing small quantities of both ethylenediamine or like amino compound, and a cyclic keto compound, such as anthraquinone. Pulping rates comparable to kraft are achieved and the pulps thereby obtained have excellent physical properties, especially tear strength.

10 Claims, No Drawings

PULPING WITH AN ALKALINE LIQUOR CONTAINING A CYCLIC KETO COMPOUND AND AN AMINO COMPOUND

BACKGROUND OF THE INVENTION

This invention relates to an improved soda pulping process for delignifying lignocellulosic materials such as wood, whole-tree chips, bagasse, straw, kenaf, reeds, and other plants and crops.

The most commonly used chemical pulping process, kraft (or sulfate) pulping, is versatile with respect to possible raw materials and cooking conditions. Its disadvantages include high capital costs, malodorous gaseous emissions, and a lack of selectivity for delignification at lower yields, whereby some of the cellulosic component of the raw material is degraded, reducing the yield of pulp.

The soda pulping process, though free from the air pollution problems of kraft pulping, usually requires much longer cooking times, and gives low yields of pulp having strength characteristics inferior to kraft pulp.

Holton teaches in a recent publication and patent (Pulp and Paper Canada 78 (10):T218 (1977), U.S. Pat. No. 4,012,280, Mar. 15, 1977) that the addition of a small amount of a cyclic keto compound, such as anthraquinone (AQ), accelerates soda pulping to kraft-like rates and yields. Soda-AQ pulping does not, however, produce pulps equal in strength, especially tear strength, to kraft pulps at comparable yields and kappa numbers (see Table I).

For example, the above-cited publication by Holton for the pulping of a mixture of spruce, balsam and pine shows the kraft control at abnormally low total yield and kappa number values for such an unbleached softwood pulp, making the soda-AQ pulp unrealistically favorable by comparison. Our data for similar pulping of black spruce (Table I) show that relative to normal kraft pulp, at conventional yields and kappa number values, unbleached soda-AQ pulp has much lower viscosity, 6% lower tensile, 22% lower tear, 10% lower burst, and 41% fewer folds. U.S. Pat. No. 4,012,280 teaches that after conventional CEDED bleaching, fully bleached soda-AQ pulp is 37% lower in viscosity, 4% lower in tear, and 5% lower in burst than the bleached kraft control. Again, the unbleached pulp has abnormally low total yield and kappa number values for such a kraft pulp.

TABLE I.

PHYSICAL PROPERTIES OF UNBLEACHED AND BLEACHED KRAFT AND SODA-AQ PULPS FROM SOFTWOOD[a]

| | UNBLEACHED | | | | BLEACHED | | | |
|---|---|---|---|---|---|---|---|---|
| | Pulp & Paper Canada 78(10):T218 (1977) | | This work | | U.S. Pat. No. 4,012,280 | | This work | |
| | Kraft SBP | Soda-AQ SBP | Kraft BS | Soda-AQ BS | Kraft SBP | Soda-AQ SBP | Kraft BS | Soda-AQ BS |
| Total yield, % | 44.2 | 48.7 | 48.2 | 48.6 | 47.0 | 48.7 | 48.8 | 51.1 |
| Unbleached Kappa number | 25.2 | 30.5 | 31.2 | 29.3 | 28.5 | 30.2 | 30.3 | 30.5 |
| Unbleached viscosity, mPa · s | — | — | 32.4 | 20.6 | 28.3 | 14.8 | 34.7 | 21.0 |
| Tensile, km | 11.7 | 12.3 | 14.9 | 14.0 | 11.8 | 11.8 | 14.4 | 14.3 |
| Tear index, mN · $m^2/g$ | 9.0 | 9.4 | 12.0 | 9.4 | 10.3 | 9.9 | 9.5 | 8.8 |
| Burst index, kPa · $m^2/g$ | 9.0 | 9.9 | 12.3 | 11.1 | 10.3 | 9.8 | 12.0 | 11.2 |
| Bulk, $cm^3/g$ | 1.20 | 1.30 | 1.34 | 1.37 | 1.30 | 1.40 | 1.27 | 1.31 |
| Elongation, % | — | — | 4.0 | 3.2 | 3.0 | 2.7 | 3.9 | 3.5 |
| PFI revs | 10,700 | 9,000 | 9,800 | 9,400 | — | — | 10,100 | 9,800 |
| Folds, MIT | — | — | 4010 | 2350 | — | — | 3990 | — |
| Brightness, % | | | | | 88.1 | 88.7 | 90.0 | 85.7 |

[a]AQ at 0.25% on O.D. wood; all mechanical strength properties at 300 ml CSF.
SBP = Spruce, balsam, pine.
BS = Black spruce.

Two of us, viz., Kubes and Bolker, reported at the TAPPI Alkaline Pulping Conference preprints, Washington, D.C., November, 1977, that the addition of a relatively large quantity of certain amino compounds (e.g., ethylenediamine (EDA)) to soda liquor resulted in pulping rates equal to or faster than that of kraft pulping, and gave pulps with superior mechanical strength properties, especially tear strength (see Table II). A disadvantage of soda-amine pulping was the high initial concentration of amine (typically at least 10% by weight, based on dry raw material) required to produce the desired effects.

We have now discovered that by adding to an alkaline, i.e., soda-type, pulping liquor very small quantities of both a cyclic keto compound and ethylenediamine or like amino compound, an unexpected synergistic effect is achieved, viz., with small quantities of both it is possible not only to delignify lignocellulosic materials at rates comparable to kraft pulping but also to obtain good yields of pulps having physical strength properties (especially tear strength) which are equal to, or better than those of comparable kraft pulps. For example, if the amino compound is EDA, the synergistic effect is such that only 0.1% by weight thereof on wood in combination with 0.1% by weight on wood of AQ, will give a pulp having 15–20% higher tear than that of soda-AQ pulp. Similarly, the synergistic effect improves the accelerating efficiency of the cyclic keto compound so that its charge may be significantly decreased, e.g., to 0.1% by weight on wood, without affecting the delignification rate.

TABLE II.

PHYSICAL PROPERTIES OF UNBLEACHED SODA, KRAFT, AND SODA-EDA PULPS FROM BLACK SPRUCE[a]

| | Soda | Soda-EDA | Kraft |
|---|---|---|---|
| Total yield, % | 43.8 | 47.3 | 48.2 |
| Kappa number | 31.5 | 33.4 | 31.2 |
| Viscosity, mPa · s | 9.4 | 27.5 | 32.4 |
| Maximum cooking temperature, °C. | 172 | 166 | 166 |
| Time to temp., min. | 90 | 90 | 90 |
| Time at temp., min. | 165 | 100 | 168 |

TABLE II.-continued

PHYSICAL PROPERTIES OF UNBLEACHED SODA, KRAFT, AND SODA-EDA PULPS FROM BLACK SPRUCE[a]

| | Soda | Soda-EDA | Kraft |
|---|---|---|---|
| Tensile, km | 11.9 | 11.4 | 14.2 |
| TEAR INDEX, mN · $m^2/g$ | 10.2 | 18.7 | 11.3 |
| Burst index, kPa · $m^2/g$ | 8.6 | 9.6 | 11.0 |
| Bulk, $cm^3/g$ | 1.44 | 1.48 | 1.37 |
| Elongation, % | 2.7 | 4.0 | 3.8 |
| PFI revs | 4,600 | 11,400 | 4,900 |
| Folds, MIT | 1780 | 2870 | 2630 |

[a]All mechanical strength properties at 500 ml CSF; data from G. J. Kubes and H. I. Bolker, TAPPI Alkaline Pulping Conference preprints, Washington, D.C., November, 1977.
[b]EDA at 40% on O.D. wood.

The use of these combined accelerators provides a pulp in higher yield at a much faster delignification rate than a similar process without the combined additives. The low doses of additives are economically favorable, chemical recovery of cooking chemicals is simplified, and the environmental pollutants of kraft pulping are decreased or eliminated.

It is a primary object of the invention to provide a soda-type pulping process which gives high yields of cellulosic pulps having physical strength properties comparable to, or better than, those of kraft pulps at equivalent yields. A second object is to delignify the raw material quickly, thus conserving energy and increasing throughput. Another object is to increase pulping rates and yields using smaller amounts of pulping accelerators. A further object is to provide a pulping process in which the discharge of gaseous and aqueous pollutants is decreased or eliminated. Other objects will be apparent to those skilled in the art.

SUMMARY OF THE INVENTION

According to this invention, there is provided, in a soda-pulping process for delignifying a lignocellulosic material wherein a cyclic keto compound is added to the pulping mixture to improve pulping rates and yields, the improvement which comprises adding to the pulping liquor a low molecular weight primary amine which is soluble in the pulping mixture in an amount which is effective in the presence of the cyclic keto compound either for decreasing the amount of the cyclic keto compound required to provide such improved pulping rate and yield or for improving the physical strength properties of the delignified pulp to kraft pulp-like values, or both, but is ineffective in the absence of the cyclic keto compound in significantly affecting either pulping rate and yield or the physical strength properties of the delignified pulp.

DETAILED DISCUSSION

In carrying out the process of this invention, a lignocellulosic material is treated with a soda pulping liquor containing both a cyclic keto compound, e.g., from 0.001% to 10.0% by weight, and an amino compound, e.g., from 0.005% to 40% by weight. The above percentages are by weight, based on the initial dry weight of the lignocellulosic material.

The cyclic keto compound preferably is a conjugated ketone in which the unsaturation and the keto group are on ring carbon atoms of a carbocyclic ring, e.g., a quinoid compound of the type described in U.S. Pat. Nos. 4,012,280 and 3,888,727, including those selected from the group comprising the anthraquinones, naphthoquinones, phenanthrenequinones, benzoquinones, their corresponding hydroquinones, anthrone, and the corresponding compounds bearing one, two or more simple substituents, e.g., alkyl, alkoxy, hydroxy, carboxy, halo and amino. Among these compounds, anthraquinone and its derivatives are preferred because of their stability to pulping conditions, their efficiency, and their relative economy of use. The cyclic keto compound is added at 0.001% to 10.0%, preferably 0.01% to 1.0%, and most preferably 0.02% to 0.25%, by weight, based on the dry weight of the lignocellulosic material.

The amino additive can be any amine which is soluble in the liquor under pulping conditions. Preferred are primary amines of low molecular weight, e.g., less than 150 and more preferably below 75 and containing 0–1 other non-hydrocarbon groups, e.g., hydroxy, ether, or amino in the molecule. Included are those selected from the group consisting of alkyl, e.g., of 1–8, preferably 1–4, carbon atoms, e.g., methyl, ethyl, isopropyl; alkylaryl, e.g., of 7–12 carbon atoms, e.g., benzyl, phenethyl; and aryl, e.g., carbocyclic, mono- and diamines, including the alkylolamines, preferably of 1–4 carbon atoms, e.g., ethanolamine. Among these compounds, primary diamines are preferred, and vicinal diamines, e.g., ethylenediamine, 1,2-propanediamine, ortho-phenylenediamine, are especially preferred. The amino compound is added at 0.01% to 40%, preferably 0.05% to 2.0%, and most preferably 0.1% to 2.0%, by weight, based on the dry weight of lignocellulosic material.

The process of the present invention is advantageous because only a very small quantity of each of the additives is needed, e.g., a combined total of less than 1%, preferably less than 0.5%, desirably even less than 0.25%, by weight of the oven-dry lignocellulosic starting material. These low additive doses are economically favourable and the compunds need not be recovered from the spent pulping liquor. When the combined additives are used in soda cooking, the gaseous pollutants typical of kraft pulping are eliminated and the total amount of water pollutants is decreased. Furthermore, delignification rates and pulp yields are much higher than from soda pulping resulting in lower energy consumption and an increased throughput.

The delignifying treatment takes place in a manner otherwise conventional to soda pulping, e.g., in a closed vessel at a maximum temperature in the range from 130° C. to 200° C. for a period of from 0.5 minutes to 480 minutes. The optimum conditions of temperature and pressure and time can be readily determined by standard industrial techniques. Following the treatment, the pulp is washed (i.e., the spent pulping liquor is displaced from the lignocellulosic material with water or an aqueous liquor inert to the lignocellulosic material), thereby producing a delignified cellulosic product which can be used directly or can be subjected to additional bleaching steps. The lignocellulosic material may be refined between pulping and washing, or after washing, using conventional refining equipment.

The lignocellulosic raw material can be coniferous wood (e.g., spruce, pine, fir), deciduous wood (e.g., maple, birch, aspen), bagasse, straw (e.g., wheat straw, rice straw), reeds, kenaf, or similar annual plants and crops. When wood is the raw material, it is converted into chip form prior to treatment; whole-tree chips fall into this category of raw material. Chipping is not necessary when a fibrous lignocellulosic material is treated.

The alkaline pulping liquor is a soda-type liquor, i.e., it contains an alkali metal hydroxide (e.g., sodium hydroxide, potassium hydroxide), possibly also including an alkali metal carbonate (e.g., sodium carbonate, potassium carbonate). Preferably, the pulping liquor is soda liquor (i.e., aqueous sodium hydroxide), wherein the alkali metal base is in the range from 8% to 25% by weight, expressed as percent effective alkali (as $Na_2O$:-TAPPI T-1203 os-61), based on the dry weight of the lignocellulosic material. Kraft (or sulfate) liquor contains from 8% to 20% by weight of an alkali metal base, expressed as percent effective alkali, and from 5% to 40% by weight of an alkali metal sulfide (e.g., sodium sulfide, potassium sulfide), expressed as percent sulfidity (TAPPI T-1203 os-61). These liquors may also contain alkali metal carbonates and/or alkali metal sulfates.

The delignifying treatment is carried out in a manner conventional for soda pulping, e.g., in a closed reaction vessel at a maximum cooking temperature in the range from 130° C. to 200° C. As water is present, the reaction takes place under supra-atmospheric pressure. The delignification lasts from 0.5 minutes to 480 minutes at maximum cooking temperature, after which the lignocellulosic material is discharged from the reaction vessel and is washed to remove the spent cooking liquor. In this delignifying treatment, the cooking liquor may also contain some spent liquor which has been recycled from a previous cook or cooks. It will be obvious to those skilled in the art that the process of the invention can be operated in two stages, viz., an impregnation step followed by the delignifying treatment (i.e, the cooking step).

The delignified, washed material (i.e., the pulp) may be further delignified by bleaching processes; such processes include CEDED treatment (i.e., chlorination, caustic extraction, chlorine dioxide treatment, caustic extraction, chlorine dioxide treatment), or other sequences incorporating bleaching stages such as oxygen-alkali treatment, peroxide treatment, hypochlorite treatment, or ozone treatment.

The following examples illustrate the process of the invention, but its scope is not limited to the embodiments shown therein.

In these experiments, pulping was conducted in 2-liter stainless steel pressure bombs rotating in a hot oil bath (250 grams oven-dry weight of chips per bomb), or in an indirect-steam-heated 20-liter stationary digester (2.0 kg oven-dry weight of chips per cook) equipped with a liquor recirculation system. Chips in baskets were pre-steamed (3 cycles of 3 minutes each at 20 psig); pulping liquor and dilution water were added so as to obtain the desired liquor-to-wood ratio (4:1) and alkali strength. Heating to maximum pulping temperature was linear: 1.6° C. per minute for bomb cooks (25° C.→170° C.), and 1.0° C. per minute (80° C.→170° C.) for 20-l digester cooks.

Cooking was terminated by immersing the bombs in cold water, or, in the case of the 20-l digester, by pressure release, cooling, and liquor draining. Pulp was transferred to a Cowles mixer, diluted with water to low consistency, and stirred for 2 minutes. The pulp was washed thoroughly with water, then screened on a 10-cut flat screen. The screened pulp was dewatered to about 30% consistency in a centrifuge, fluffed, and samples from the weighed pulp were taken for moisture, yield, Kappa and viscosity measurements.

In the following examples, the standard methods for testing were:

| | | |
|---|---|---|
| Kappa number | TAPPI | T 236 os-76 |

-continued

| | | |
|---|---|---|
| 0.5% CED Viscosity | TAPPI | T 230 os-76 |
| Handsheet forming | CPPA | C.4 |
| Brightness | CPPA | E.1 |
| Breaking length | CPPA | D.34 |
| Tear index | CPPA | D.9 |
| Burst index | CPPA | D.8 |
| Bulk | CPPA | D.5 |
| Folds | CPPA | D.17P |

A PFI mill was used to process the pulps prior to mechanical strength testing.

EXAMPLE 1

Ten samples of black spruce chips were pulped according to the process of the invention, employing anthraquinone as the cyclic keto compound and ethylenediamine as the amino compound. Six control samples were also pulped: two in soda liquor containing no additives, two in soda liquor containing only anthraquinone, and two in conventional kraft liquor. Cooking was conducted as described above. The pulping conditions and results are shown in Table III, and the physical characteristics of the pulps are given in Table IV.

The results demonstrate that the combined addition of EDA plus AQ gives pulps at better yields and lower kappa numbers than can be obtained from soda pulping without the additives. Also, very low additions of both compounds (e.g., 0.1% by weight of each) to soda liquor give a pulp with higher tear strength than can be obtained when the only additive, used at 0.25% by weight, is AQ. The soda-EDA-AQ pulps equal or exceed kraft pulps in tear strength, and compare favorably in breaking length.

EXAMPLE 2

Six samples of black spruce chips were pulped according to the process of the invention, employing anthraquinone or its 2-methyl derivative as the cyclic keto compound, plus a variety of amino compounds. The pulping was carried out as described above. The pulping conditions and results are shown in Table V, and the strength data for the pulps are given in Table VI.

The results show that pulps with tear strengths equivalent to kraft pulp (see Table IV) can be obtained when a very low charge of an alternative diamine (e.g., 1,2-propanediamine) is the amino compound, or when an alternative cyclic keto compound (e.g., 2-methylanthraquinone) is employed. Amine compounds which do not have two amino groups are somewhat less effective in this respect, but the soda-additive pulps so produced are still significantly better in physical strengths than soda control pulps.

EXAMPLE 3

Various species of softwoods, a mixed hardwood, and bagasse were pulped by the process of the invention as well as by the soda-AQ and kraft processes. Cooking was conducted as described above. The pulping conditions and results are shown in Table VII, and the physical characteristics of the pulps are given in Table VIII.

For southern pine (as for black spruce discussed in Example 1), soda-EDA-AQ pulp from 0.1% does of both additives was equivalent in strength to soda-AQ pulp using 0.25% AQ on wood. For Douglas fir and western hemlock, the kraft pulps were best overall; in these cases, soda-EDA-AQ pulp at 0.1% doses appeared to have only a marginal tear strength advantage over soda-AQ pulp. Soda-EDA-AQ pulping of mixed hardwoods produced pulp almost identical to soda-AQ pulp, but at a higher unbleached yield. For bagasse, soda-EDA-AQ pulp exceeded soda-AQ pulp in total yield, tear, burst and tensile strengths, and was much better in total yield and tear than soda pulp.

better than kraft pulp. Table X shows that the unbleached tear advantage of the soda-combined additive pulps over soda-AQ pulp is preserved when the pulps are bleached; after bleaching, the soda-combined additive pulps are comparable to kraft pulp in mechanical strengths.

TABLE III.

AKALINE PULPING WITH AQ PLUS EDA - PULPING DATA[a]

| | | ADDITIVES[b] | | | | PULPING CONDITIONS | | RESULTS | | |
|---|---|---|---|---|---|---|---|---|---|---|
| Run no. | Type of cook | Cyclic keto compound | % on wood | Amine compound | % on wood | % A.A. | Time at 170°, min. | Total yield, % | Kappa no. | Viscosity, mPa · s |
| 1 | Soda additive | AQ | 0.25 | EDA | 10.0 | 17.5 | 106 | 48.3 | 40.3 | 44.5 |
| 2 | Soda additive | AQ | 0.25 | EDA | 5.0 | 17.5 | 90 | 47.8 | 46.7 | 41.3 |
| 3 | Soda additive | AQ | 0.25 | EDA | 2.0 | 17.5 | 90 | 49.2 | 49.0 | 33.2 |
| 4 | Soda additive | AQ | 0.25 | EDA | 1.0 | 17.5 | 90 | 48.8 | 47.5 | 28.1 |
| 5 | Soda additive | AQ | 0.25 | EDA | 0.50 | 17.5 | 90 | 50.1 | 46.5 | 27.3 |
| 6 | Soda additive | AQ | 0.25 | EDA | 0.50 | 18.0 | 112 | 48.9 | 31.2 | 21.4 |
| 7 | Soda additive | AQ | 0.20 | EDA | 0.30 | 18.0 | 112 | 48.4 | 32.9 | 21.1 |
| 8 | Soda additive | AQ | 0.20 | EDA | 0.20 | 18.0 | 112 | 49.6 | 32.7 | 20.6 |
| 9 | Soda additive | AQ | 0.10 | EDA | 0.10 | 20.0 | 110 | 47.3 | 29.3 | 15.9 |
| 10 | Soda additive | AQ | 0.25 | NONE | | 18.0 | 90 | 51.1 | 30.5 | 21.0 |
| 11 | Soda additive | AQ | 0.25 | NONE | | 18.5 | 106 | 48.6 | 29.3 | 20.6 |
| 12 | Soda | NONE | | NONE | | 18.0 | 100 | 54.5 | 98.5 | 19.4 |
| 13 | " | NONE | | NONE | | 20.0 | 165 | 43.8 | 31.5 | 9.4 |
| 14 | Kraft[c] | NONE | | NONE | | 18.0 | 80 | 49.6 | 36.2 | 35.6 |
| 15 | " | NONE | | NONE | | 18.0 | 125 | 46.5 | 24.1 | 27.2 |

[a]Wood species: black spruce. All cooks at 90 minutes to 170° max. pulping temp.
[b]AQ = anthraquinone; EDA = ethylenediamine.
[c]For kraft cooks, the liquor contained 12.6% NaOH and 5.4% $Na_2S$, both as % $Na_2O$ based on o.d. wood.
A.A. = Active alkali (as $Na_2O$:TAPPI T-1203 os-61).

EXAMPLE 4

Three samples of black spruce chips were pulped according to the process of the invention, two employing ethylenediamine and anthraquinone as the combined additives, and one employing 1,2-propanediamine and anthraquinone as the combined additives. Two control cooks were also made, one by the soda-AQ process and one by the kraft process. The pulping was carried out as described above.

The five pulps were then bleached by the conventional CEDED sequence (C=chlorination, E=caustic extraction, D=chlorine dioxide treatment). The bleaching treatments are given in Table IX, and the physical strength results of the fully-bleached pulps are shown in Table X.

The soda-combined additive pulps (Runs 40,41,42) had approximately the same bleaching chemical demands as the kraft and soda-AQ pulps, although the pulp resulting from higher EDA and AQ charges (Run 41) required somewhat less chlorine than the other pulps. In final brightness, the combined-additive pulps are significantly better than soda-AQ pulp, and slightly

TABLE IV.

ALKALINE PULPING WITH AQ PLUS EDA - UNBLEACHED PULP STRENGTH DATA[a]

| Run No. | Tear index, mN · $m^2$/g | Burst index, kPa · $m^2$/g | Breaking length, km | Bulk, $cm^3$/g | MIT double folds | Revolutions, PFI mill |
|---|---|---|---|---|---|---|
| 1 | 13.7 | 9.8 | 11.8 | 1.44 | 1810 | 7,600 |
| 2 | 13.0 | 9.0 | 12.1 | 1.44 | 1690 | 7,600 |
| 3 | 13.5 | 8.7 | 11.6 | 1.47 | 1540 | 7,200 |
| 4 | 12.5 | 9.3 | 12.6 | 1.46 | 2160 | 6,600 |
| 5 | 12.4 | 9.2 | 12.8 | 1.48 | 1670 | 6,500 |
| 6 | 11.0 | 9.4 | 13.4 | 1.45 | 2030 | 5,900 |
| 7 | 11.7 | 9.3 | 12.9 | 1.48 | 1500 | 5,900 |
| 8 | 11.1 | 9.2 | 13.0 | 1.48 | 1850 | 6,200 |
| 9 | 11.2 | 9.2 | 12.9 | 1.45 | 1630 | 4,900 |
| 10 | 9.3 | 9.8 | 13.6 | 1.37 | 2360 | 4,300 |
| 11 | 9.8 | 10.8 | 14.2 | 1.40 | 1790 | 6,400 |
| 12 | 10.9 | 8.2 | 10.2 | 1.58 | 1470 | 8,200 |
| 13 | 10.2 | 8.6 | 11.9 | 1.44 | 1780 | 4,600 |
| 14 | 11.5 | 11.2 | 14.0 | 1.39 | 3050 | 4,600 |
| 15 | 11.1 | 11.2 | 14.4 | 1.35 | 2860 | 4,400 |

[a]All results at 500 ml CSF.

TABLE V.

AKALINE PULPING WITH COMBINED ADDITIVES - PULPING DATA[a]

| | ADDITIVES[b] | | | | PULPING CONDITIONS | | | RESULTS | |
|---|---|---|---|---|---|---|---|---|---|
| Run No. | Cyclic Keto compound | % on wood | Amine compound | % on wood | % A.A. | Time at 170° min. | Total yield, % | Kappa no. | Viscosity, mPa · s |
| 16 | AQ | 0.1 | 1,2-PDA | 0.1 | 20.0 | 110 | 46.4 | 30.2 | 17.7 |
| 17 | AQ | 0.1 | MEA | 0.1 | 17.5 | 101 | 49.4 | 39.3 | 22.1 |
| 18 | AQ | 0.25 | MEA | 0.5 | 17.5 | 103 | 49.1 | 34.4 | 20.8 |
| 19 | AQ | 0.25 | MA | 0.25 | 17.5 | 101 | 49.2 | 39.8 | 21.1 |
| 20 | 2-MAQ | 0.1 | EDA | 0.1 | 17.5 | 101 | 49.3 | 38.8 | 22.6 |
| 21 | 2-MAQ | 0.25 | EDA | 0.5 | 17.5 | 103 | 48.9 | 31.7 | 20.8 |

[a]Wood species: black spruce. All cooks at 90 minutes to 170° max. pulping temperature.
[b]AQ = anthraquinone; 2-MAQ = 2-methyl-anthraquinone; 1,2-PDA = 1,2 propanediamine; MEA = monethanolamine; EDA = ethylenediamine; MA = methylamine.
A.A. = Active alkali (as $Na_2O$:TAPPI T-1203 os-61).

TABLE VI.

ALKALINE PULPING WITH COMBINED ADDITIVES - UNBLEACHED PULP STRENGTH DATA

| Run No. | Tear index, mN · m²/g | Burst index, kPa · m²/g | Breaking length, km | MIT double folds | Revolutions PFI mill |
|---|---|---|---|---|---|
| 16 | 11.6 | 8.9 | 11.6 | 1470 | 5,500 |
| 17 | 10.6 | 9.3 | 11.9 | 1070 | 7,900 |
| 18 | 10.4 | 9.6 | 12.8 | 1410 | 6,500 |
| 19 | 11.1 | 9.3 | 12.2 | 1240 | 7,500 |

TABLE VI.-continued

ALKALINE PULPING WITH COMBINED ADDITIVES - UNBLEACHED PULP STRENGTH DATA

| Run No. | Tear index, mN · m²/g | Burst index, kPa · m²/g | Breaking length, km | MIT double folds | Revolutions PFI mill |
|---|---|---|---|---|---|
| 20 | 11.6 | 9.6 | 12.2 | 1240 | 8,100 |
| 21 | 11.1 | 9.6 | 12.6 | 1320 | 6,400 |

[a]All results at 500 ml CSF. All pulps had bulk values of 1.43-1.45 cm³/g.

TABLE VII.

AKALINE PULPING WITH COMBINED ADDITIVES: VARIOUS WOOD AND PLANT MATERIALS - PULPING DATA[a]

| | | ADDITITVES | | | | PULPING CONDITIONS | | | RESULTS | |
|---|---|---|---|---|---|---|---|---|---|---|
| Run no. | Species | Cyclic keto compound | % on wood | Amine compound | % on wood | % A.A. | Time at 170° C. min. | Total yield, % | Kappa no. | Viscosity, mPa · s |
| 22 | | AQ | 0.1 | EDA | 0.1 | 18.5 | 117 | 40.8 | 39.5 | 22.6 |
| 23 | Douglas | AQ | 0.5 | EDA | 0.5 | 18.5 | 117 | 41.7 | 32.5 | 20.5 |
| 24 | fir | AQ | 0.25 | NONE | | 17.5 | 118 | 41.2 | 25.5 | 23.9 |
| 25 | | KRAFT CONTROL COOK | | | | 18.0 | 128 | 39.3 | 29.2 | 31.5 |
| 26 | | AQ | 0.1 | EDA | 0.1 | 18.5 | 113 | 44.3 | 44.9 | 19.1 |
| 27 | Western | AQ | 0.5 | EDA | 0.5 | 18.5 | 117 | 44.2 | 35.9 | 18.5 |
| 28 | hemlock | AQ | 0.25 | NONE | | 17.5 | 113 | 44.2 | 36.6 | 20.4 |
| 29 | | KRAFT CONTROL COOK | | | | 18.0 | 128 | 42.3 | 31.6 | 32.0 |
| 30 | | AQ | 0.1 | EDA | 0.1 | 19.5 | 113 | 48.2 | 44.7 | 20.4 |
| 31 | Southern | AQ | 0.5 | EDA | 0.5 | 19.5 | 113 | 47.5 | 36.0 | 19.9 |
| 32 | pine | AQ | 0.25 | NONE | | 19.5 | 120 | 46.8 | 31.0 | 17.9 |
| 33 | | AQ | 0.25 | NONE | | 18.0 | 107 | 47.6 | 41.1 | 22.1 |
| 34 | | AQ | 0.1 | EDA | 0.1 | 16.0 | 88 | 46.5 | 25.7 | 21.5 |
| 35 | Mixed | AQ | 0.1 | EDA | 0.5 | 16.0 | 87 | 46.2 | 30.5 | 27.1 |
| 36 | hardwoods | AQ | 0.1 | NONE | | 16.0 | 86 | 45.5 | 24.8 | 25.9 |
| 37 | | AQ | 0.2 | EDA | 0.2 | 14.0 | 60 | 56.1 | 18.4 | 38.6 |
| 38 | Bagasse[b] | AQ | 0.2 | NONE | | 14.0 | 60 | 53.6 | 19.1 | 35.1 |
| 39 | | SODA CONTROL COOK | | | | 14.0 | 60 | 51.7 | 21.1 | 34.6 |

[a]All wood samples were cooked at 90 minutes at 170° maximum pulping temperature.
[b]Bagasse was cooked at 60 min. to 155°, 60 min. at 155°; L:W = 6.4:1.
AA = Active alkali (as $Na_2O$:TAPPI T-1203 os-61).

TABLE VIII.

AKALINE PULPING WITH COMBINED ADDITIVES: VARIOUS WOODS AND PLANT MATERIALS - UNBLEACHED PULP STRENGTH DATA[a]

| Run no. | Species | Tear index, mN · m²/g | Burst index, kPa · m²/g | Breaking length, km | Bulk, cm³/g | MIT double folds | Revolutions, PFI mill |
|---|---|---|---|---|---|---|---|
| 22 | | 19.5 | 5.6 | 7.6 | 1.64 | 790 | 9,000 |
| 23 | Douglas | 18.1 | 6.4 | 8.9 | 1.61 | 990 | 10,200 |
| 24 | fir | 18.9 | 5.9 | 8.1 | 1.63 | 1000 | 7,600 |
| 25 | | 20.6 | 6.3 | 8.6 | 1.60 | 1100 | 8,000 |
| 26 | | 10.7 | 8.2 | 11.0 | 1.49 | 1190 | 7,100 |
| 27 | Western | 10.2 | 8.5 | 11.4 | 1.47 | 990 | 5,700 |
| 28 | hemlock | 10.3 | 8.5 | 11.2 | 1.46 | 1630 | 5,900 |
| 29 | | 11.6 | 9.2 | 12.1 | 1.42 | 2090 | 7,100 |
| 30 | | 21.9 | 5.6 | 8.4 | 1.81 | 690 | 8,700 |
| 31 | Southern | 20.3 | 5.8 | 7.9 | 1.75 | 670 | 7,500 |
| 32 | pine | 20.0 | 6.1 | 8.8 | 1.76 | 790 | 7,000 |

TABLE VIII.-continued

AKALINE PULPING WITH COMBINED ADDITIVES: VARIOUS WOODS AND PLANT MATERIALS - UNBLEACHED PULP STRENGTH DATA[a]

| Run no. | Species | Tear index, mN · m²/g | Burst index, kPa · m²/g | Breaking length, km | Bulk, cm³/g | MIT double folds | Revolutions, PFI mill |
|---|---|---|---|---|---|---|---|
| 33 | | 21.7 | 6.0 | 8.3 | 1.78 | 780 | 7,700 |
| 34 | | 9.2 | 4.9 | 8.5 | 1.53 | 120 | 2,100 |
| 35 | Mixed | 9.3 | 4.8 | 8.4 | 1.54 | 120 | 2,800 |
| 36 | Hardwoods | 9.1 | 5.0 | 8.5 | 1.51 | 150 | 2,800 |
| 37 | | 9.6 | 5.3 | 8.1 | 1.69 | 190 | 1,000 |
| 38 | Bagasse | 9.1 | 4.7 | 7.5 | 1.73 | 150 | 800 |
| 39 | | 7.7 | 5.6 | 8.8 | 1.58 | 280 | 400 |

[a]All results at 500 ml CSF.

TABLE IX.

BLEACHING OF COMBINED ADDITIVE PULPS - BLEACHING CONDITIONS[a]

| Bleaching Run No. | Unbleached pulp from Run No. | Type of Pulp[b] | C Cl₂, % In. | C Cl₂, % Res. | E NaOH % | E NaOH final pH | D ClO₂, % In. | D ClO₂, % Res. | D ClO₂, % final pH | E NaOH % | E NaOH final pH | D ClO₂, % In. | D ClO₂, % Res. | Brightness | Bleached pulp yield % on wood | Bleached pulp yield % on pulp | Viscosity mPa · s |
|---|---|---|---|---|---|---|---|---|---|---|---|---|---|---|---|---|---|
| 40 | 9 | EDA/AQ | 6.5 | 0.3 | 3.8 | 11.2 | 1.4 | 0.2 | 4.0 | 1.0 | 11.3 | 0.5 | 0.2 | 89.1 | 44.7 | 94.5 | 12.3 |
| 41[c] | — | EDA/AQ | 6.3 | 0.3 | 3.7 | 11.3 | 1.4 | 0.1 | 3.7 | 1.0 | 11.4 | 0.5 | 0.2 | 89.4 | 45.6 | 96.5 | 12.7 |
| 42 | 16 | PDA/AQ | 6.7 | 0.3 | 3.9 | 11.3 | 1.4 | 0.2 | 3.8 | 1.0 | 11.2 | 0.5 | 0.2 | 90.1 | 43.9 | 94.7 | 11.5 |
| 43 | 10 | AQ | 6.6 | 0.2 | 4.0 | 11.4 | 1.4 | 0.2 | 1.9 | 0.6 | 11.4 | 0.3 | 0.1 | 85.7 | ND | ND | 17.7 |
| 44[d] | — | KRAFT | 6.8 | 0.6 | 3.8 | 12.1 | 1.2 | 0.2 | 2.8 | 1.0 | 11.6 | 0.4 | 0.1 | 88.2 | 45.3 | 92.7 | 24.9 |

Wood species: black spruce.
EDA = ethylenediamine; AQ = anthraquinone; PDA = 1,2-propanediamine.
Soda-0.3% EDA-0.15% AQ cooking at 170° C. gave this unbleached pulp at 47.3% total yield, 27.1 kappa, and 16.0 mPa · s viscosity.
Kraft cooking (at 30% sulphidity) at 166° C. gave this unbleached pulp at 48.9% total yield, 30.3 kappa, and 29.2 mPa · s viscosity.
ND = Not determined.

TABLE X.

BLEACHING OF COMBINED ADDITIVE PULPS - PHYSICAL STRENGTH DATA[a]

| Run No. | Tear index, mN · m²/g | Burst index, kPa · m²/g | Breaking length km | Bulk, cm³/g | MIT Double folds | Revolutions, PFI mill |
|---|---|---|---|---|---|---|
| 40 | 9.8 | 10.1 | 13.2 | 1.37 | 1150 | 4,400 |
| 41 | 10.0 | 9.9 | 13.2 | 1.37 | 1230 | 4,400 |
| 42 | 10.4 | 10.0 | 13.0 | 1.39 | 1180 | 4,400 |
| 43 | 9.0 | 10.6 | 13.8 | 1.34 | — | 3,900 |
| 44 | 9.7 | 11.0 | 14.2 | 1.31 | 2480 | 4,000 |

[a]All results at 500 ml CSF.

What is claimed is:

1. In a pulping process for delignifying a lignocellulosic material wherein a cyclic keto compound and a low molecular weight primary diamine which is soluble in the pulping mixture are added to the pulping mixture to improve pulping rates and yields, the improvement which comprises adding to the pulping liquor of an aqueous soda-type alkaline pulping process an amount, between 0.05% and 2% by weight based on the oven-dry weight of the lignocellulosic material, of the primary diamine which is effective in the presence of the cyclic keto compound either for decreasing the amount of the cyclic keto compound required to provide such improved pulping rate and yield or for improving the physical strength properties of the delignified pulp to kraft pulp-like values but which is ineffective in the absence of the cyclic keto compound to significantly affect any of pulping rate, yield and the physical strength properties of the delignified pulp.

2. A process as claimed in claim 1 wherein the diamine is ethylenediamine and the pulping liquor contains from 0.1% to 2.0% by weight thereof, based on the oven-dry weight of the lignocellulosic material.

3. A process as claimed in claim 2 wherein the cyclic keto compound is anthraquinone.

4. A process as claimed in claim 2 wherein the cyclic keto compound is 2-methyl-anthraquinone.

5. A process as claimed in claim 1 wherein the alkaline pulping liquor contains from 0.01% to 1.0% by weight of the cyclic keto compound, based on the oven-dry weight of the lignocellulosic material.

6. A process as claimed in claim 5 wherein the cyclic keto compound is anthraquinone and the diamine is ethylenediamine and the pulping liquor contains from 0.1% to 2.0% by weight of the ethylenediamine, based on the oven-dry weight of the lignocellulosic material.

7. A process as claimed in claim 5 wherein the lignocellulosic material is coniferous wood, the pulping liquor contains from 0.02% to 0.25% by weight of the cyclic ketone and from 0.1% to 2.0% by weight of the diamine, both weights being based on the oven-dry weight of the coniferous wood.

8. A process as claimed in claim 7 wherein the cyclic keto compound is anthraquinone and the diamine is ethylenediamine.

9. A process as claimed in claim 7 wherein the alkaline pulping liquor is soda liquor and the combined total of the cyclic keto compound and the diamine is less than 0.5% by weight of the oven-dry weight of the lignocellulosic material.

10. A process as claimed in claim 1 wherein the delignified cellulosic material is afterward subjected to conventional bleaching.

* * * * *